US009824562B2

(12) United States Patent
Wilging

(10) Patent No.: US 9,824,562 B2
(45) Date of Patent: Nov. 21, 2017

(54) WIRELESS AUDIO SYSTEM USING SMOKE DETECTORS WITH INTEGRATED AUDIO SYSTEMS PAIRED FOR MOBILE DEVICE OUTPUT

(71) Applicant: Philip J. Wilging, Yucaipa, CA (US)

(72) Inventor: Philip J. Wilging, Yucaipa, CA (US)

(73) Assignee: SMOKE AUDIO INC., Yucaipa, CA (US)

( * ) Notice: Subject to any disclaimer, the term of this patent is extended or adjusted under 35 U.S.C. 154(b) by 0 days.

(21) Appl. No.: 15/114,381

(22) PCT Filed: Jan. 13, 2015

(86) PCT No.: PCT/US2015/011265
§ 371 (c)(1),
(2) Date: Sep. 13, 2016

(87) PCT Pub. No.: WO2015/156867
PCT Pub. Date: Oct. 15, 2015

(65) Prior Publication Data

US 2017/0011608 A1 Jan. 12, 2017

Related U.S. Application Data

(60) Provisional application No. 61/977,592, filed on Apr. 9, 2014.

(51) Int. Cl.

| | |
|---|---|
| ***G08B 21/00*** | (2006.01) |
| ***G08B 17/10*** | (2006.01) |
| ***G08B 25/10*** | (2006.01) |
| ***H04R 1/02*** | (2006.01) |
| *G08B 3/10* | (2006.01) |
| *G08B 21/14* | (2006.01) |

(52) U.S. Cl.
CPC ..... *G08B 17/10* (2013.01); *G08B 25/10* (2013.01); *H04R 1/028* (2013.01); *G08B 3/10* (2013.01); *G08B 21/14* (2013.01); *H04R 2420/07* (2013.01)

(58) Field of Classification Search
CPC ..... G08B 17/10; G08B 25/10; G08B 21/14; G08B 3/10; H04R 1/028; H04R 2420/07
USPC ..... 340/628
See application file for complete search history.

(56) References Cited

U.S. PATENT DOCUMENTS 4,107,464 A * 8/1978 Lynch ..... G08B 27/00 340/692
4,453,222 A * 6/1984 Goszyk ..... G08B 3/10 340/521
5,594,410 A 1/1997 Lucas et al.
(Continued)

*Primary Examiner* — Mark Rushing
(74) *Attorney, Agent, or Firm* — Law Office of Dorian Cartwright; Dorian Cartwright

(57) ABSTRACT

A system for pairing a smoke detector based audio system with a device for wireless audio. The system has a smoke detector circuit with an integrated audio system. The device is paired to the smoke detector circuit using a communications protocol and used to output audio from a speaker. The system has an alarm circuit and an alarm speaker, that can be separate from the audio speaker. The alarm circuit is connected to one or more detection device for determining hazardous conditions. If a hazardous condition is detected, the audio from the device is overridden and alarm audio is output to warn of the hazardous condition.

6 Claims, 4 Drawing Sheets

(56) References Cited

U.S. PATENT DOCUMENTS

| | | | | |
|---|---|---|---|---|
| 5,663,714 | A * | 9/1997 | Fray | G08B 7/06 340/326 |
| 2010/0031295 | A1 | 2/2010 | Krzyzanowski et al. | |
| 2012/0210785 | A1 | 8/2012 | Casey | |
| 2012/0269361 | A1 | 10/2012 | Bhow et al. | |
| 2012/0274767 | A1 | 11/2012 | Hornback | |
| 2013/0012227 | A1 | 1/2013 | Nadler et al. | |

* cited by examiner

WIRELESS AUDIO SYSTEM USING SMOKE DETECTORS WITH INTEGRATED AUDIO SYSTEMS PAIRED FOR MOBILE DEVICE OUTPUT

CROSS-REFERENCE TO RELATED APPLICATIONS

This Application is a 371 of PCT/US2015/011265 filed Jan. 13, 2015, which claims the benefit under 35 U.S.C. §119(e) of U.S. Provisional Patent Application Ser. No. 61/977,592, filed on Apr. 9, 2014, the content of each being hereby incorporated by reference in their entirety.

FIELD OF THE INVENTION

The invention relates generally to audio electronics, and more specifically, to a system for pairing a smoke detector based audio system with a mobile device for wireless audio.

BACKGROUND

Wireless audio systems allow users to playback audio from an ever growing number of play back capable electronic devices. For example, smart telephones and tablets are able to wirelessly stream radio stations and videos stored in the cloud. Typically, these devices have insufficient audio output capabilities because they are not primarily designed for such use.

Furthermore, speaker systems that are installed within a home for the purpose of audio playback are contrary to the nature of untethered devices. These devise are tethered to a stereo receiver by an auxiliary cord for a hard wired connection. Even wireless connections to the stereo receiver require wires for output. Speakers are connected to the speaker by speaker wires. Some expensive speaker systems still need to be connected to an outlet for power.

Therefore, there is a need for a system for pairing a smoke detector based audio system with a mobile device for wireless audio that overcomes these shortcomings in the prior art.

BRIEF DESCRIPTION OF THE DRAWINGS

These and other features, aspects and advantages of the present invention will become better understood with regard to the following description, appended claims, and accompanying figures where:

SUMMARY

Figure 1:
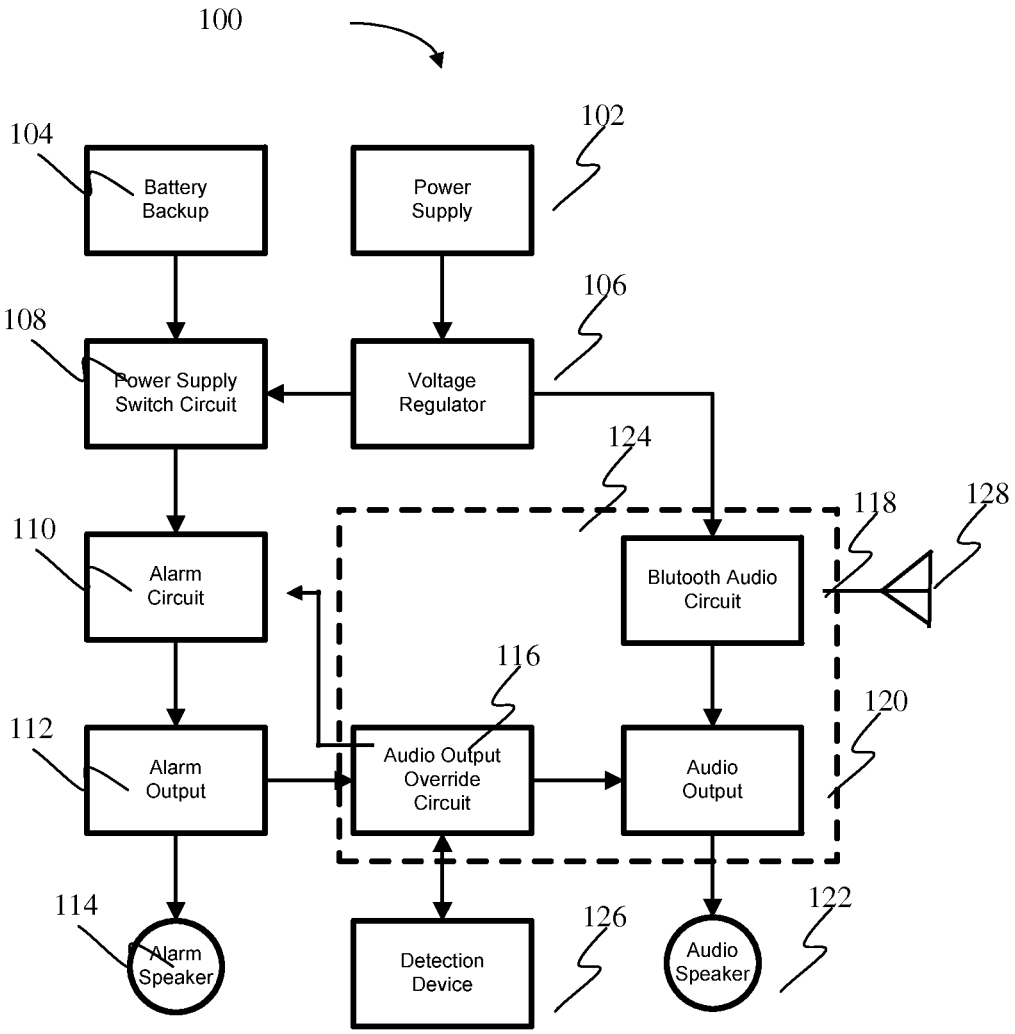
FIG. 1 is a block diagram illustrating a smoke detector circuit 100 with an integrated audio system, according to an embodiment.

The system for pairing a smoke detector based audio system with a device for wireless audio described herein overcomes the problems with the prior art. The system comprises a smoke detector circuit with an integrated audio system. A computing device, such as, for example, a smartphone or tablet, is communicatively coupled to the smoke detector circuit using a communications protocol. One or more than one speaker is connected to the smoke detector and the computing device for outputting audio.

The smoke detector circuit comprises: a power supply; a voltage regulator connected to the power supply; a power supply switch circuit connected to the voltage regulator; a battery backup connected to the power supply switch circuit to provide emergency power in the event of a power supply failure; an alarm circuit connected to the power supply switch circuit; an alarm output connected to the alarm circuit; an alarm speaker connected to the alarm output; an audio system circuit connected to the voltage regulator; one or more than one detection device connected to the audio system circuit and the alarm circuit; and one or more than one audio speaker connected to the audio system circuit. The alarm circuit is configured to provide warnings for hazardous conditions, such as, for example, smoke, carbon, carbon monoxide, house security, and chemical hazards. Additionally, the battery backup is only activated for smoke detection for extra protection against the possibility of electrical power loss due to fire. The alarm circuit is also independent of the audio system circuit for code compliance and to minimize liability. The alarm output is configured to output a piercing audio sound, a visual alert or both an audio signal and a visual alert, such as a strobe light.

The audio system circuit comprises: an audio output circuit; an audio output override circuit connected to the alarm output and the audio output; a communications audio circuit coupled to the audio output; and one or more than one audio speaker connected to the audio output. The communications audio circuit has one or more than one radios and antennas to transmit and receive one or more than one audio stream from one or more than one external audio source and to transmit and receive alarm information from one or more than one different smoke detectors. The communications audio circuit can link various other systems, like the one described or other disparate systems, to each other for information sharing. The alarm speaker and the audio speaker can be the same speaker to reduce costs. However, in a higher end system, there can be a range of speakers to provide better sound quality. The audio output override circuit is activated when a dangerous condition is detected by one or more than one detection device. The one or more than one detection device comprises internal detectors, external detectors or both internal and external detectors communicatively couple to one another. External detectors are communicatively coupled to the system wirelessly, wired or both wirelessly and wired depending upon the detector's capabilities. The detection devices can be a smoke detector, a fire detector, a carbon monoxide detector, home security detectors or any combination thereof.

There is also provided a method for pairing a smoke detector based audio system with a computing device for wireless audio. First a smoke detector comprising an integrated audio system available for pairing with an external device comprising a processor is identified. Then, instructions to connect to the smoke detector to the external computing device using a communications protocol are executed. Next, audio is output through the smoke detector from the external computing device. Then, any existing dangerous condition are detected. The audio output from the external computing device is overridden and an alarm is output through the speaker. The communication protocol consists of the group selected from a Bluetooth® protocol, a WiFi protocol and a Near Field Communications protocol and is preferably, the Bluetooth® protocol.

There is also provided another method for an application for pairing a smoke detector based audio system with a computing device for wireless audio. First, the system hardware is provided. Then, instructions for the application executable on a processor are retrieved from a storage and stored memory on a computing device. Next, the instructions are executed on the computing device, including instructions for accessing a GPS, a WiFi or both a CPS and WiFi network to determine a location of the computing device. Then, a preference list is accessed to determine a priority of available smoke detectors to be paired. Next, the computing device is paired with the preferred smoke detector based audio system, if the preference list is available. Otherwise, the signal strength of the available smoke detector based audio systems is determined and the computing device is paired with the smoke detector based audio system with the strongest signal. An error message is displayed on the computing device if there is no preference list or an available smoke detector based audio system within range. The steps are repeated as long as the computing device is executing the application. Additionally, there are instructions for a manual override for pairing the smoke detector and the computing device. This way a user can decide what devices will be paired where the smoke detector accepts input from the computing device, such as, controlling volume levels, selecting sources of external audio to be output, and responding to voice commands. The user can also store a priority list of pairing options for a specific location determined.

DETAILED DESCRIPTION

The present invention overcomes the limitations of the prior art by providing a system for pairing a smoke detector based audio system with a mobile device for wireless audio. The system provides methods, computer programs, and various sub-systems for paring a smoke detector based audio system with a mobile device for wireless audio.

In one embodiment, a mobile device identifies smoke detectors with integrated audio systems available for paring. A radio within smoke detectors broadcasts a presence, or responds to an interrogation from a mobile device seeking a connection. In response, the mobile device connects over a Bluetooth® or other suitable communication medium with a selected smoke detector in order to transmit a digital audio stream to a smoke detector. The smoke detector uses integrated circuitry to decode and output the audio stream through one or more integrated speakers.

The term "mobile device" refers to a smart phone, a tablet computer, a laptop computer, a smart watch, an MP3 player, a set top box, or any other suitable mobile or stationary device comprising a processor capable of executing instructions useful for the system. In some embodiments, the mobile device includes a mobile application offering enhanced functionality. The mobile application is capable of storing smoke detector identifications for automatic connection upon entering within range. Further, the mobile application can control volume levels and select sources of audio. The mobile application can be an intermediary with other audio applications or be part of an application that sources audio. Examples of sources can include MP3 players (playing locally stored files), streaming radio stations (e.g. iHeart Radio or Pandora), video sources (e.g. YouTube), video games, and the like.

The smoke detector can include a mesh that is suitable for speaker output as well as air flow input to allow detection of dangerous conditions. The audio speakers can be positioned for maximum sound dispersion. The smoke detector, having a dedicated 120V power source, is able to also provide power to audio speakers through hardwire connections within drywall without installation of additional wiring (e.g. speaker wire or power cord). The shared power source is not shared with respect to a backup power battery power source (e.g. 9V battery). In some embodiments, an LED light illuminates while the Bluetooth® connection is active along with audio output. The implementation is also cost effective relative to WiFi wireless speakers that still require a power cord.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a system or device disclosed in this disclosure will be determined by its intended use.

Methods and devices that implement the embodiments of the various features of the invention will now be described with reference to the drawings. The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific detail. Well-known circuits, structures and techniques may not be shown in detail in order not to obscure the embodiments. For example, circuits may be shown in block diagrams in order not to obscure the embodiments in unnecessary detail.

Also, it is noted that the embodiments may be described as a process that is depicted as a flowchart, a flow diagram, a structure diagram, or a block diagram. The flowcharts and block diagrams in the figures can illustrate the architecture, functionality, and operation of possible implementations of systems, methods and computer programs according to various embodiments disclosed. In this regard, each block in the flowchart or block diagrams can represent a module, segment, or portion of code, that can comprise one or more executable instructions for implementing the specified logical function(s). It should also be noted that, in some alternative implementations, the functions noted in the blocks may occur out of the order noted in the figures. Although a flowchart may describe the operations as a sequential process, many of the operations can be performed in parallel or concurrently. In addition, the order of the operations may be rearranged. A process is terminated when its operations are completed. A process may correspond to a method, a function, a procedure, a subroutine, a subprogram, etc. When a process corresponds to a function, its termination corresponds to a return of the function to the calling function or the main function. Additionally, each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Moreover, a storage may represent one or more devices for storing data, including read-only memory (ROM), random access memory (RAM), magnetic disk storage mediums, optical storage mediums, flash memory devices and/or other non-transitory machine readable mediums for storing information. The term "machine readable medium" includes, but is not limited to portable or fixed storage devices, optical storage devices, wireless channels and various other non-transitory mediums capable of storing, comprising, containing, executing or carrying instruction(s) and/or data.

Furthermore, embodiments may be implemented by hardware, software, firmware, middleware, microcode, or a combination thereof. When implemented in software, firmware, middleware or microcode, the program code or code segments to perform the necessary tasks may be stored in a machine-readable medium such as a storage medium or other storage(s). One or more than one processor may perform the necessary tasks in series, distributed, concurrently or in parallel. A code segment may represent a procedure, a function, a subprogram, a program, a routine, a subroutine, a module, a software package, a class, or a combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted through a suitable means including memory sharing, message passing, token passing, network transmission, etc. and are also referred to as an interface, where the interface is the point of interaction with software, or computer hardware, or with peripheral devices.

Various embodiments provide a system for pairing a smoke detector based audio system with a mobile device for wireless audio. One embodiment of the present invention provides a circuit for a system for pairing a smoke detector based audio system with a mobile device for wireless audio. In another embodiment, there is provided a method for using the system. The system and method will now be disclosed in detail.

Referring now to FIG. 1, there is shown a block diagram illustrating a smoke detector circuit 100 with an integrated audio system, according to one embodiment. The smoke detector circuit 100 comprises a power supply 102 coupled to a voltage regulator 106 that provides power to an alarm circuit 110 and an audio system circuit 124. The alarm circuit 110 is configured to provide warnings for hazardous conditions, such as, for example, smoke, carbon, carbon monoxide, chemicals or other dangerous conditions. A battery backup 104 is connected to the power supply switch circuit 108 to provide emergency power in the event of a power supply 102 failure. A power supply circuit switch circuit 108, connected to the battery backup 104 and the alarm circuit 110, activates the battery backup 104 in the event of a power supply 102 failure, for smoke detection functionality only. Optionally, the alarm circuit 110 can be independent of the audio system circuit 124 for code compliance and to minimize liability in some installations. The alarm output 112 is connected to the alarm circuit 110 and an alarm speaker 114 that is configured to output a piercing audio sound, a visual alert or both an audio signal and a visual alert, such as, for example, a loud, high pitched siren and/or a flashing light in response to the detection of dangerous conditions.

Additionally, the audio system circuit 124 comprises a Bluetooth® audio circuit 118 coupled to an audio output 120 that is coupled to one or more than one audio speaker 122. The Bluetooth® audio circuit comprises one or more than one radios and antennas 128 to transmit and receive one or more than one audio stream from one or more than one external audio source. The audio output 120 decodes the one or more than one audio stream and converts the digital stream to an analog output for the audio speakers, as is known in the art. The one or more than one audio speaker 122 can comprise a high fidelity speaker or a speaker that is optimized for music and other audio outputs. In another embodiment, the alarm speaker 114 and the audio speaker 122 are the same.

Additionally, the system 100 comprises an audio output override circuit 116 that is activated when a dangerous condition is detected by one or more than one detection device 126. The one or more than one detection device 126 comprises internal detectors, external detectors or both internal and external detectors. The one or more than one external detector 126 is communicatively coupled to the system 100 wirelessly, wired or both wirelessly and wired. The one or more than one detection device 126 can comprise a smoke detector, a fire detector, a carbon monoxide detector, one or more than one home security detector or any combination thereof. The one or more than one detection device 126 transmits a signal to active the alarm output 112. Additionally, a signal is transmitted to the audio output override circuit 116 to stop the audio output 120 to the one or more than one audio speaker 122 so that the alarm speaker 114 is the only sound being heard for safety purposes. Optionally, when the alarm speaker 114 and the audio speaker 122 are different speakers, the audio output override circuit 116 is configured to switch the audio output 120 to transmit the alarm output 112. In another embodiment, the alarm output comprises prerecorded, real-time, or both prerecorded and real-time verbal warning messages.

Figure 2:
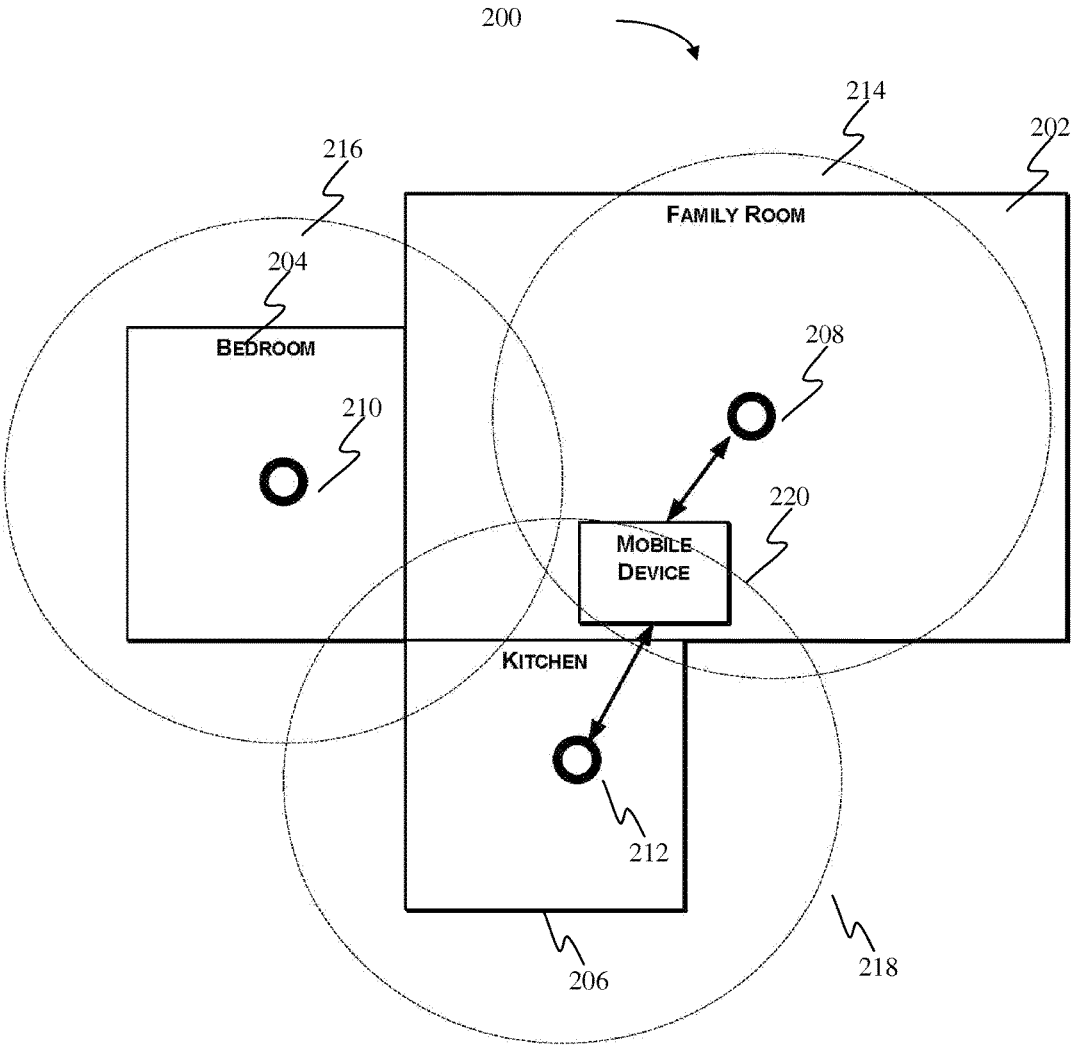
FIG. 2 is a block diagram illustrating a system of smoke detectors having overlapping ranges.

Referring now to FIG. 2, there is shown a block diagram of an interconnected system 200 of smoke detectors 208, 210 and 212 with overlapping ranges 214, 216 and 218. The overlapping ranges 214, 216 and 218 cause a conflict with a mobile device 220 as to which smoke detector 208, 210 and 212 to pair with and communicate.

In this case, the mobile device 220 has an option of connecting to a family room 202 smoke detector and a kitchen 212 smoke detector. The system comprises instructions executable on a processor, hereinafter the mobile application, to pair with the strongest signal received by the mobile device 220. Alternatively, the user experience, or history of connections, is used to modify the inherent hardware selection processes. For example, although the kitchen 206 smoke detector 212 is closer, the mobile application executing on the mobile device 220 comprises instructions to determine that the mobile device 220 is actually located in the family room 202. Therefore, the family room 202 smoke detector 208 is a preferred pairing with the mobile device 220. The mobile application comprises instructions to store user input that lists a priority of pairing options to a specific location. As a result, the mobile application will automatically select the family room 202 smoke detector 208 when a geolocation mechanism such as GPS or WiFi triangulation indicates that mobile device 220 is located in the family room 202.

Also, as the mobile device is moved from room to room 2002, 204 and 206, the mobile application connects to different smoke detectors 208, 210 and 212 based off the detected location of the mobile device 220.

Figure 3:
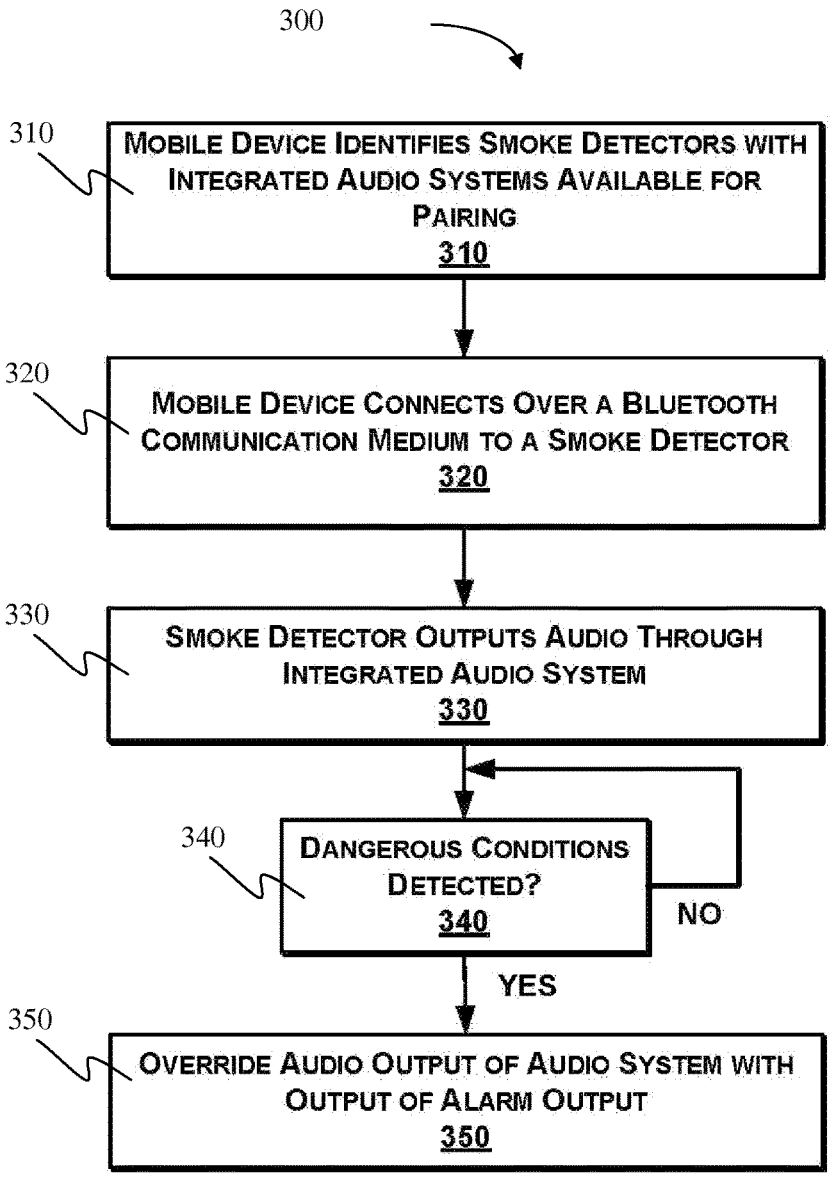
FIG. 3 is a flow diagram illustrating a method 300 for pairing a mobile device with a smoke detector for audio output.

Referring now to FIG. 3, there is shown a flowchart diagram 300 of some steps of a method for pairing a mobile device 220 with the system 100 for audio output. First, the mobile device identifies 310 smoke detectors 208, 210 and 212 that are available for pairing. Next, the mobile device 220 executes instructions to connect to the smoke detector 208, 210 and 212 using a communications protocol 320. The protocol consists of the group selected from a Bluetooth® protocol, a WiFi protocol and a Near Field Communications protocol. Preferably, the Bluetooth® protocol is used to communicate with the smoke detector 208, 210 and 212. Then, the smoke detector 208, 210 and 212 outputs audio through an integrated audio system. Next, a detecting if a dangerous condition exists 340. If a dangerous condition is detected 340, then the audio output 120 is overridden 350 and the alarm output 112 it output through the one or more than one speaker 114 and 122.

Figure 4:
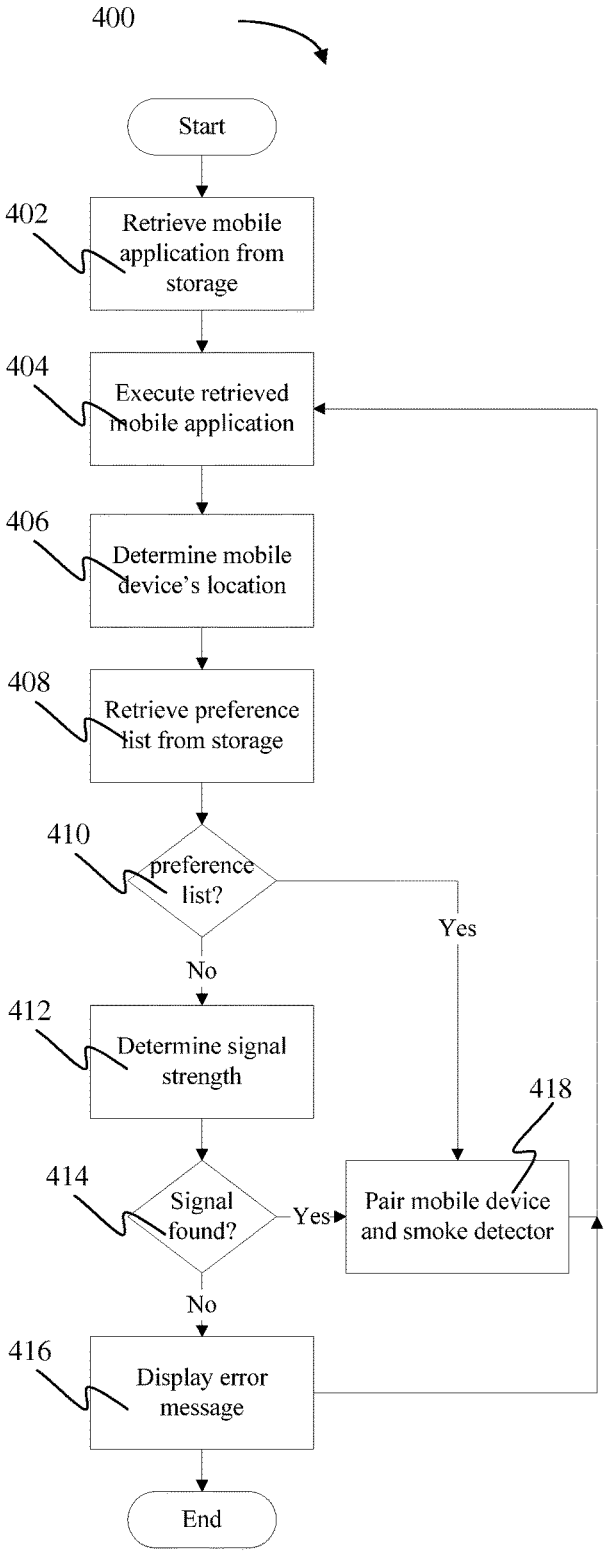
FIG. 4, there is shown a flowchart diagram 400 some steps of a method for a mobile application for pairing a smoke detector based audio system with a mobile device 220 for wireless audio.

Referring now to FIG. 4, there is shown a flowchart diagram 400 some steps of a method for a mobile application for pairing a smoke detector based audio system with a mobile device 220 for wireless audio. The method comprises the steps of first retrieving instructions 402 executable on a processor from a storage and storing the instructions in a memory on a device. Then, executing 404 the instructions on one or more than one processor in the device. Preferably, the device is a mobile device 220, such as, for example, a smartphone or a tablet. Next, the mobile application executes instructions for accessing a GPS or WiFi network to determine a location 406 of the mobile device 220. Then, the mobile application accesses a preference list 408 from the storage to determine a priority of available smoke detector based audio systems are to be paired. Next, if the preference list is provided 410, the mobile device 220 pairs with the preferred smoke detector based audio system 418. If there is no stored preference list, then the mobile application determines the signal strength 412 of the available smoke detector based audio systems. Next, the mobile application executes instructions to pair the mobile device 220 with the smoke detector based audio system 418 with the strongest signal determined. Then, if there is no preference list or an available smoke detector based audio system within range 414 of the mobile device 220, the mobile application displays an error message 416 on the mobile device 220. The steps above are repeated as long as the mobile device 220 is executing the mobile application. In another embodiment, the mobile application executes in a background process on the mobile device 220.

What has been described is a new and improved system and method for a system for pairing a smoke detector based audio system with a mobile device for wireless audio, overcoming the limitations and disadvantages inherent in the related art. Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. §112.

What is claimed is:

1. A wireless mobile device in a combination smoke detector and wireless audio playback system in which the wireless mobile device uses room borders to select a wireless connection to a plurality of smoke detector audio playback devices with integrated wireless audio playback, the wireless mobile device comprising:

an interface to receive a preferred pairing selection of among the plurality of smoke detector audio playback devices which comprises a preconfigured pairing between the plurality of smoke detector audio playback devices associated with range of a specified location, through a point-to-point connection, the preferred pairing selection holding priority over signal strength and distance to the wireless external device;

a radio to detect a wireless connection availability from a first smoke detector of the plurality of smoke detectors and at least a second smoke detector of the plurality of smoke detectors with integrated wireless audio playback for the wireless external device and initiate a wireless connection; and a processor to select one of the first smoke detector and the second smoke detector that was detected by the radio responsive to pairing preferences over signal strength and distance, wherein each of the smoke detector audio playback devices comprise:

an enclosure;

a power supply selector switch, coupled to a wired power source to receive power and coupled to a battery back-up power source to receive power;

a smoke detector circuit driving an alarm speaker, within the enclosure and coupled to the power supply selector switch, the smoke detector circuit receiving power from the power supply under normal operations and receiving power from the battery back-up power source when power from the power supply is not available;

a speaker circuit driving an audio speaker to playback audio from a wirelessly-connected external device, within the enclosure and also coupled to receive power from the power supply under normal operations and not receiving power from the battery back-up power source when power from the power supply is not available;

a wireless radio circuit to connect to the wireless mobile device with a point-to-point wireless technology; and an override circuit, within the enclosure and coupled to both the smoke detector circuit and to the speaker circuit, the override circuit receiving a signal from the smoke detector circuit and, in response, send a first signal to interrupt audio playback from the audio speaker and send a second signal to activate an audible alarm from the alarm speaker.

2. The smoke detector audio playback device of claim 1, wherein the smoke detector device connects with the wireless device to establish a Bluetooth or Wi-Fi wireless connection.

3. The smoke detector audio playback device of claim 1, wherein the smoke detector generates the interrupt signal responsive to detecting at least one of: smoke, fire, carbon monoxide, temperature, humidity, and a hazardous chemical.

4. The smoke detector audio playback device of claim 1, wherein the audio playback comprises music playback.

5. The smoke detector audio playback device of claim 1 in wireless communication with an external hazard detector, wherein the external hazard detector sends a signal to the smoke detector device responsive to detecting a hazardous condition, and wherein the smoke detector device drives the alarm speaker to alert of the hazardous condition detected by the external hazard detector.

6. The smoke detector audio playback of claim 5, wherein the external hazard detector comprises a security hazard detector, and the hazardous condition comprises a security hazard.

* * * * *